US006784617B2

(12) United States Patent
Jeong et al.

(10) Patent No.: US 6,784,617 B2
(45) Date of Patent: Aug. 31, 2004

(54) SUBSTRATE AND PLASMA DISPLAY PANEL UTILIZING THE SAME

(75) Inventors: Jae-Seok Jeong, Asan (KR); Tae-Kyoung Kang, Cheonan (KR)

(73) Assignee: Samsung SDI Co., LTD, Suwon-si (KR)

( * ) Notice: Subject to any disclaimer, the term of this patent is extended or adjusted under 35 U.S.C. 154(b) by 0 days.

(21) Appl. No.: 10/080,547

(22) Filed: Feb. 25, 2002

(65) Prior Publication Data

US 2002/0130620 A1 Sep. 19, 2002

(30) Foreign Application Priority Data

Mar. 13, 2001 (KR) ..... 2001-12890

(51) Int. Cl.[7] ..... H01J 17/49

(52) U.S. Cl. ..... 313/586; 313/292; 313/238; 315/169.4

(58) Field of Search ..... 345/60, 74.1–74.76, 345/55; 313/238, 292, 582, 583, 584, 585, 586, 587; 315/169.3, 169.4

(56) References Cited

U.S. PATENT DOCUMENTS 5,825,128 A 10/1998 Betsui et al.
5,967,872 A 10/1999 Betsui et al. ..... 445/24
6,376,986 B1 * 4/2002 Takagi et al. ..... 313/582
6,411,032 B1 * 6/2002 Shiiki et al. ..... 313/582
6,495,967 B2 * 12/2002 Kao et al. ..... 315/169.4
6,603,263 B1 * 8/2003 Hashimoto et al. ..... 313/584

FOREIGN PATENT DOCUMENTS

JP 09-50768 2/1997
JP 2000-11894 1/2000

* cited by examiner

*Primary Examiner*—Edward J. Glick
*Assistant Examiner*—Elizabeth Keaney
(74) *Attorney, Agent, or Firm*—Robert E. Bushnell, Esq.

(57) ABSTRACT

A plasma display panel includes a substrate, a dielectric layer formed on a top surface of the substrate, and partitions spaced a predetermined distance apart from each other and having a snaking or meandering shape. The partitions form channels having main discharge spaces and auxiliary discharge spaces alternately arranged and connected to each other. Red (R), green (G) and blue (B) phosphors are coated on the main discharge spaces in a triangular shape and where G and R phosphors are aligned with each other in a horizontal direction. The thicknesses of partitions forming the main discharge spaces where the R and G phosphors are coated are greater than thicknesses of the partitions forming the main discharge spaces where the B phosphor is coated.

18 Claims, 4 Drawing Sheets

SUBSTRATE AND PLASMA DISPLAY PANEL UTILIZING THE SAME

CLAIM OF PRIORITY

This application makes references to, incorporates the same herein, and claims all benefits accruing under 35 U.S.C. §119 from an application for SUBSTRATE AND PDP UTILIZING THE SAME earlier filed in the Korean Industrial Property Office on Mar. 13, 2001, and there duly assigned Serial No. 12890/2001 by that Office.

BACKGROUND OF THE INVENTION

1. Field of the Invention

The present invention relates to a plasma display panel (PDP), and more particularly, to a substrate having improved partitions to prevent crosstalk between pixels and improved arrangement of phosphor patterns, and a PDP utilizing the same.

2. Description of the Related Art

A plasma display panel (PDP) generates light by exciting fluorescent materials or special discharge gases to form an image using the light. The plasma display panels are largely classified into an alternating current (AC) type, a direct current (DC) type, and a hybrid type.

The conventional AC type PDP includes a transparent front substrate sealed with a rear substrate to form a discharge space, electrodes formed on at least one side of the rear substrate and the front substrate to cause a plasma discharge in the discharge space, and partitions disposed in the discharge space to partition the discharge space and prevent crosstalk between pixels. In the above-described PDP, however, phosphors emitting red light (R), green light (G) and blue light (B), coated in the discharge space partitioned by the partitions, cause a severe difference in luminous efficiency between the respective colors. For example, the luminous efficiency ratio of the R, G and B phosphors is 3:6:1. That is, the luminous efficiency of the B phosphors is very low. To solve this problem, attempts to control a white balance or the coating area of fluorescent materials are being made through adjustment of the magnitude of an image signal. Since the magnitudes of R and G signals are more reduced as compared with a B signal, the display of gray scales of an image may not be properly performed. Also, adjustment of the coating area only exhibits a negligible effect of increasing the luminous efficiency, and causes a smaller discharge margin due to a change in the voltage between discharge cells caused by a change in the gap between electrodes.

Partition walls of a plasma display panel are disclosed in U.S. Pat. No. 5,967,872 issued to Betsui et al. for Method for Fabrication of a Plasma Display Panel, which claims priority from Japanese Laid-open Publication No. hei 09-50768. The separator walls have a zigzag, snaking or meandering shape to form channels having relatively wide discharge cells and relatively narrow connecting portions. According to the PDP having the above-described configuration, while the luminous efficiency can be improved, the white balance characteristics are not improved, which will now be described in more detail.

A white balance refers to a condition in which a constant color temperature characteristic is maintained in the periods of 0–255 gray scales irrespective of gray scales. In a PDP, it is quite difficult to maintain a constant color temperature characteristic irrespective of gray scales. Generally, a high color temperature characteristic is exhibited in lower gray scales, and gradually decreasing color temperature characteristics are exhibited in higher gray scales. It is the luminous efficiency ratio of R and G phosphors that is one of factors most sensitive to color temperature characteristic.

In the conventional PDP, it is often the case that the luminous efficiency of the G phosphor is increased to enhance the brightness of the PDP. However, this enhancement also causes the color temperature characteristic to be deteriorated. In the zigzag, snaking separator walls of U.S. Pat. No. 5,967,872 issued to Betsui et al., the light-emitting area of a discharge cell is so large as to increase the luminous efficiency of a phosphor, exerting a luminance increasing effect. According to this structure, since the sizes of discharge cells coated with R, G and B phosphors are the same, the luminous efficiency ratio of R, G and B phosphors is not so different from that of a conventional striped discharge cell structure. Thus, improvement in color temperature characteristic cannot be attained in every period of 0 to 255 gray scales.

SUMMARY OF THE INVENTION

It is therefore an object of the present invention to provide a plasma display panel to both improve the luminous efficiency of a blue (B) phosphor, the luminous efficiency of which is relatively low in a defined discharge space, and to improve a white balance characteristic.

It is another object to improve the color temperature of a plasma display panel along with the luminous efficiency and the white balance characteristics.

It is yet another object to prevent a decrease in the opening ratio of the third main discharge spaces since common electrodes and sustaining electrodes are arranged at a boundary between first and second main discharge spaces and a third main discharge space.

It is still another object to have a plasma display panel that is easier and less expensive to manufacture.

Additional objects and advantages of the invention will be set forth in part in the description which follows and, in part, will be obvious from the description, or may be learned by practice of the invention.

To accomplish the above and other objects, a plasma display panel according to an embodiment of the present invention includes a substrate, a dielectric layer formed on a top surface of the substrate, partitions spaced a predetermined distance apart from each other and formed in a snaking or meandering shape to form a plurality of channels having main discharge spaces and auxiliary discharge spaces alternately arranged and connected to each other to form channels and red (R), green (G) and blue (B) phosphors coated on the main discharge spaces in a triangular shape with the G and R phosphors aligned with each other in a horizontal direction.

According to another aspect of the present invention, the partitions include first partition portions forming main discharge spaces, second partition portions forming auxiliary discharge spaces, and third partition portions connecting the first and second partition portions, and thicknesses of the first partition portions forming the main discharge spaces where the R and G phosphors are coated are greater than those of the first partition portions forming the main discharge spaces where the B phosphor is coated.

According to another embodiment of the present invention, a plasma display panel includes a substrate, a dielectric layer formed on a top surface of the substrate, first partitions disposed in a striped pattern, spaced a predetermined distance apart from each other on the top surface of the dielectric layer and having recessed portions at opposite sides, and second partitions spaced a predetermined distance apart from each other in a snaking shape, forming main discharge spaces in cooperation with the recessed portions and forming auxiliary discharge spaces in cooperation with lateral surfaces of the first partitions adjacent to the recessed portions.

According to another aspect of the present invention, red (R) and green (G) phosphors are coated in main discharge spaces formed by the first and second partitions, and a blue (B) phosphor is coated in the main discharge spaces formed by the adjacent second partitions. According to yet another embodiment of the present invention, a plasma display panel includes a substrate, data electrodes formed on the top surface of the substrate in a predetermined pattern, a first dielectric layer formed on the surface of the substrate to cover the data electrodes, first partitions having a striped pattern spaced a predetermined distance apart from each other on a top surface of the first dielectric layer and having recessed portions at opposite sides, second partitions spaced a predetermined distance apart from each other in a snaking shape, forming main discharge spaces in cooperation with the recessed portions and forming auxiliary discharge spaces in cooperation with lateral surfaces of the first partitions adjacent to the recessed portions, a front plate sealed with the substrate, common electrodes and sustaining electrodes arranged in the main discharge spaces in a non-parallel direction with a direction of the data electrodes on a bottom surface of the front plate, and a second dielectric layer formed on the bottom surface of the front plate to cover the common and sustaining electrodes.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
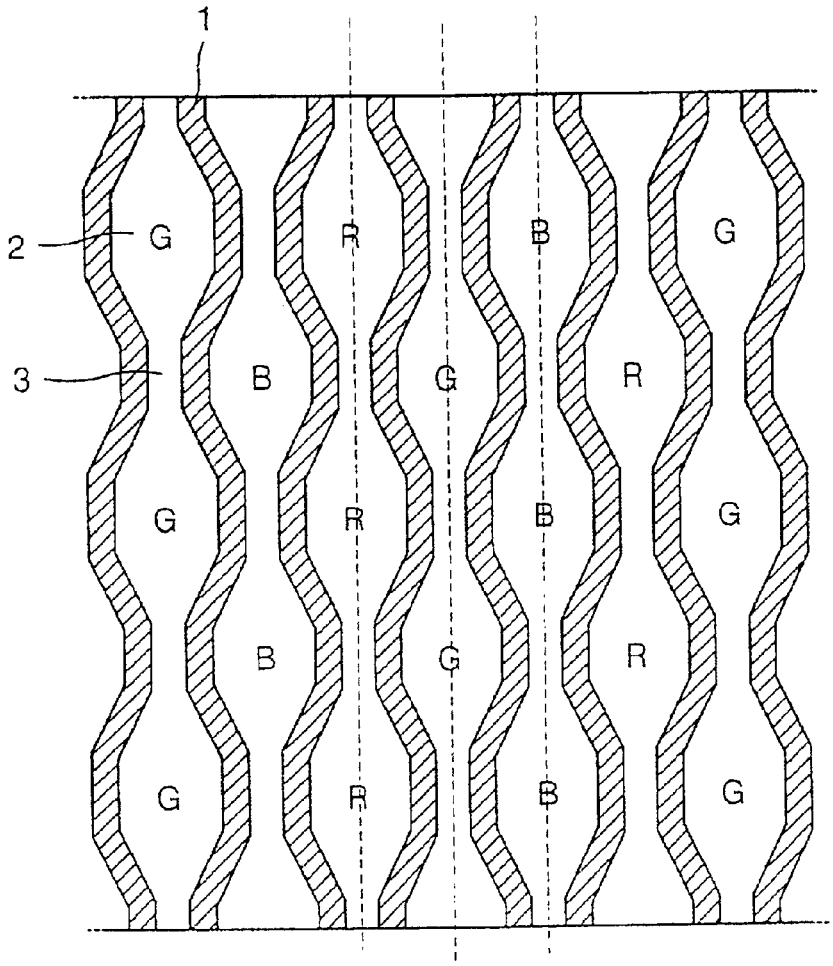
FIG. 1 (PRIOR ART)
FIG. 1 is an exploded perspective view of a conventional plasma display panel.

Turning now to the drawings, FIG. 1 shows partition walls of a plasma display panel such as those disclosed in U.S. Pat. No. 5,967,872 issued to Betsui et al. for *Method for Fabrication of a Plasma Display Panel,* which claims priority from Japanese Laid-open Publication No. hei 09-50768. As shown in FIG. 1, separator walls 1 have a zigzag, snaking or meandering shape to form channels having relatively wide discharge cells 2 and relatively narrow connecting portions 3. According to the PDP having the above-described configuration, while the luminous efficiency can be improved, the white balance characteristics are not improved.

Figure 2:
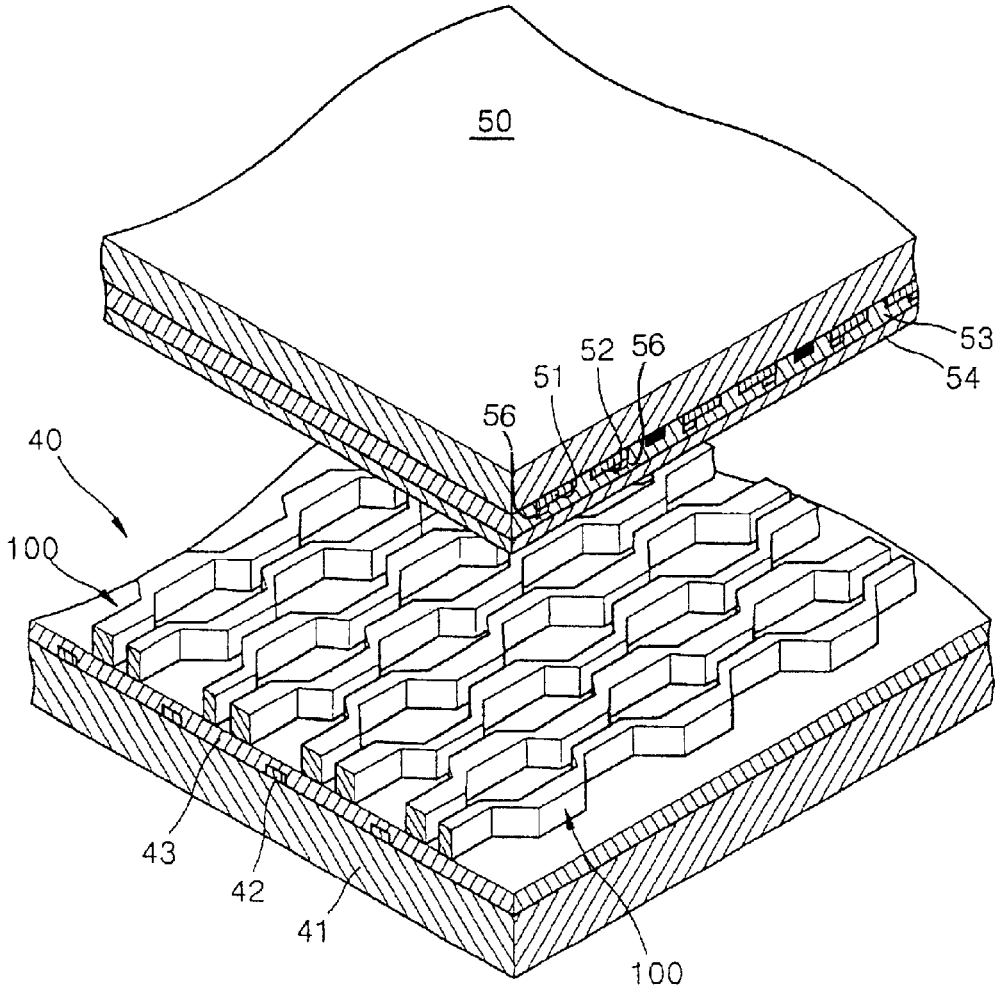
FIG. 2 is an exploded perspective view of a plasma display panel according to an embodiment of the present invention.
Figure 3:
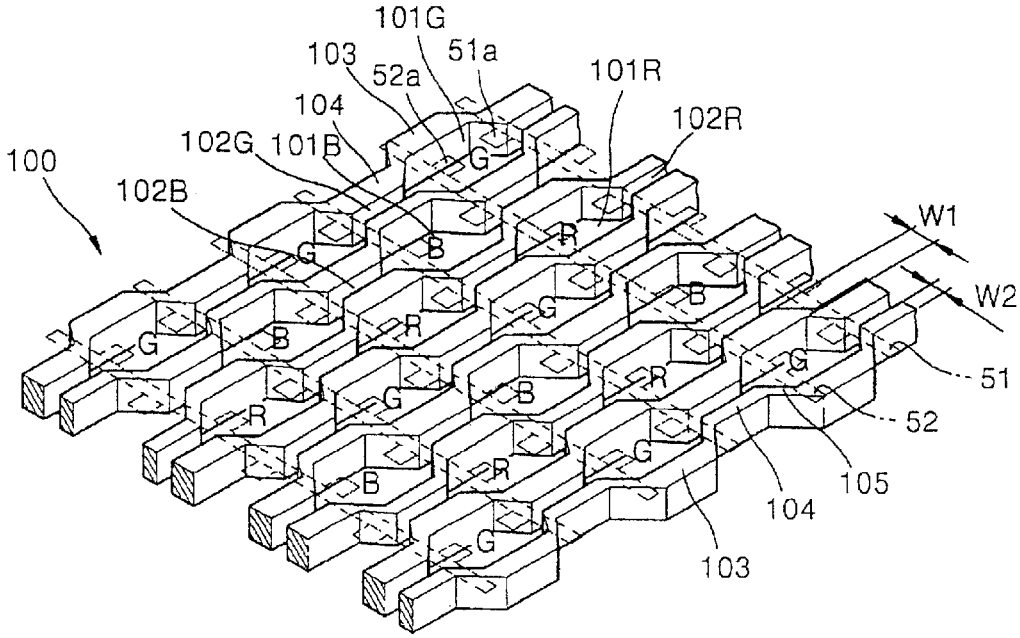
FIG. 3 is a plan view of the substrate shown in FIG. 2.
Figure 4:
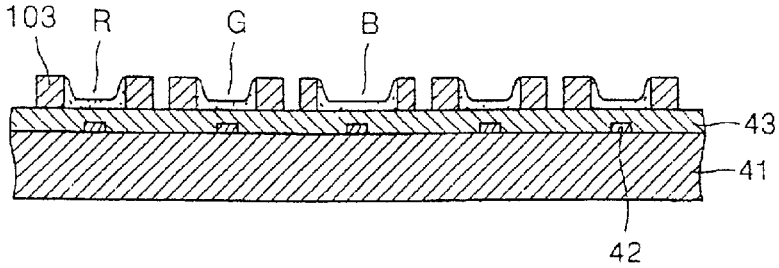
FIG. 4 is a cross-sectional view of the substrate shown in FIG. 3.

FIGS. 2, 3 and 4 show a plasma display panel (PDP) including a substrate having partitions according to an embodiment of the present invention. A PDP 40 includes a substrate 41, data electrodes 42 formed on a top surface of the substrate 41 in a predetermined pattern (i.e., spaced a predetermined distance apart from and parallel to each other), and a first dielectric layer 43 formed on a surface of the substrate 41 to cover the data electrodes 42. Partitions 100 defining discharge spaces are formed on the first dielectric layer 43. The substrate 41 having the partitions 100 is sealed with a transparent front plate 50 by a sealant (not shown) to hermetically close the discharge spaces. Pairs of common electrodes 51 and sustaining electrodes 52, each having a corresponding bus electrode 56 are formed in a predetermined pattern on a bottom surface of the front plate 50 in a direction crossing a direction of the data electrodes 42. At least one pair of the common electrodes 51 and sustaining electrodes 52 are arranged in one discharge space. A second dielectric layer 53 is formed on the front plate 50 to cover the common electrodes 51 the sustaining electrodes 52 and the corresponding bus electrodes 56. A protective film 54, often made of MgO, is formed on a top surface of the second dielectric layer 53.

In the PDP 40 having the aforementioned configuration, the partitions 100 are spaced a predetermined distance apart from each other on the top surface of the first dielectric layer 43. The partitions 100 meander continuously to form a plurality of channels having first, second, and third main discharge spaces 101R, 101G and 101B, and first, second and third auxiliary discharge spaces 102R, 102G and 102B. The first, second and third main discharge spaces 101R, 101G and 101B and the first, second and third auxiliary discharge spaces 102R, 102G and 102B are alternately arranged and connected to each other to form channels. R, G and B phosphors are formed in the first, second and third auxiliary discharge spaces 102R, 102G and 102B and first, second and third main discharge spaces 101R, 101G and 101B, respectively, to form a fluorescent layer of the PDP. The respective R, G and B phosphors are arranged such that the R phosphors are aligned with the G phosphors in a horizontal direction. Each of the partitions 100 includes a first partition portion 103 forming a main discharge space, a second partition portion 104 forming an auxiliary discharge space, and a third partition portion 105 connecting the first and second partition portions 103 and 104. A width W1 of the first partition portion 103 is greater than a width W2 of the second or third partition portion 104 or 105. Thus, the area of the third main discharge space 101B, where the B phosphor is coated, is relatively wider than the area of the first or second main discharge spaces 101R or 101I where the R and G phosphors are coated.

Here, the B phosphor may further be coated on the partition portions more thickly than the R and G phosphors.

In order to increase an opening ratio of the main discharge spaces 101R, 101G, 101B, the common electrode 51 and the sustaining electrode 52 formed on the front plate 50 are preferably arranged on portions corresponding to the third partition portion 105 as shown in FIG. 3. Also, in order to reduce a discharge starter voltage and extend the relative discharge area, auxiliary electrodes 51*a* and 52*a*, which are positioned in the main discharge space and extend from opposing sides of the common and sustaining electrodes 51 and 52, are formed. The auxiliary electrodes 51*a* and 52*a* may be formed of transparent ITO (indium tin oxide) or metal of a mesh shape. The shapes of the auxiliary electrodes 51*a* and 52*a* are not limited to those shown in the above-described embodiment and may be embodied in various shapes in consideration of the opening ratio, discharge area and voltage for plasma discharge. Further, the location of the electrodes 51 and 52 need not be as shown, and the auxiliary electrodes 51*a* and 52*a* need not be used in all embodiments of the invention.

Figure 5:
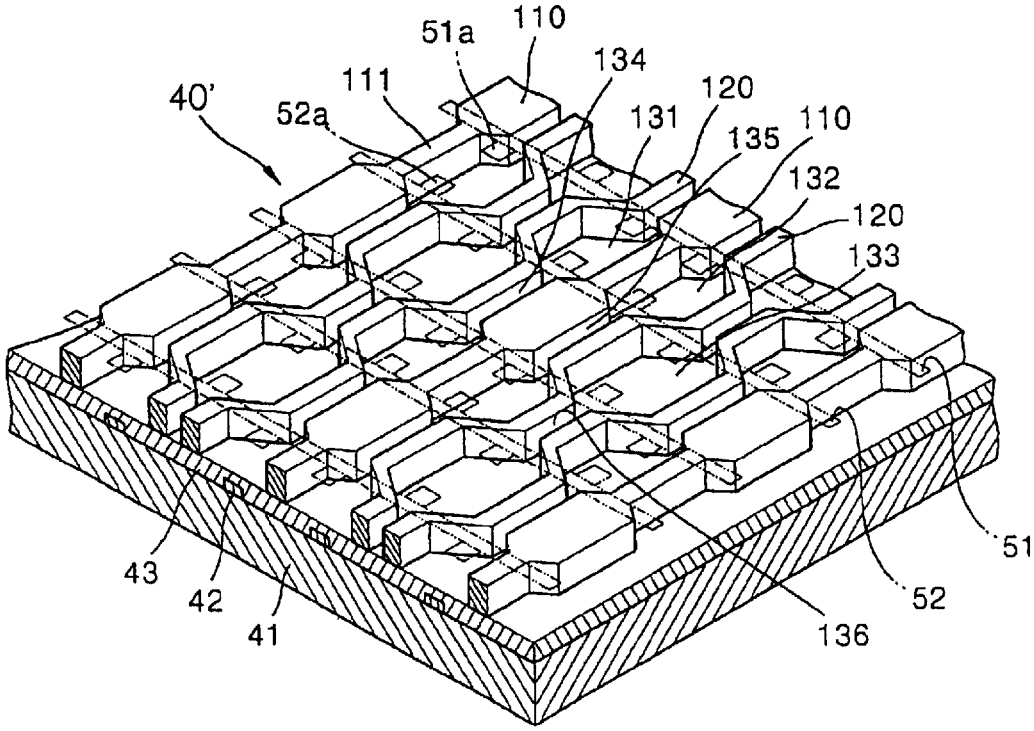
FIG. 5 is a plan view of a substrate according to another embodiment of the invention.

FIG. 5 shows a PDP 40' having partitions according to another embodiment of the present invention, in which the same reference numerals denote the same elements as in the above-described embodiment. As shown in FIG. 5, data electrodes 42 are formed on a top surface of a substrate 41 in a predetermined pattern. A first dielectric layer 43 is formed on the top surface of the substrate 41 to cover the data electrodes 42. First partitions 110 of a striped pattern having recessed portions 111 formed at opposite sides are spaced a predetermined distance apart from each other on a top surface of the first dielectric layer 43. Second partitions 120 forming first and second main discharge spaces 131 and 132 where R and G phosphors are coated are formed at either side of each of the first partitions 110. A third main discharge space 133, where a B phosphor is coated, is formed by the second partitions 120. The second partitions 120 form auxiliary discharge spaces 134 and 135 in cooperation with the lateral surfaces of the first partitions 110 adjacent to the recessed portions 111. The second partitions 120 form another auxiliary discharge space 136 between adjacent lateral surfaces of the second partition 120.

Here, the first, second and third main discharge spaces 131, 132 and 133, respectively, where the R, G and B phosphor, are coated, are disposed in a triangular arrangement. Specifically, each color is a corner of the triangle as shown in FIG. 5. The area of the third main discharge space 133, where the B phosphor is coated, is relatively wider than the area of the first or second main discharge space 131 or 132, respectively. Common electrodes 51 and sustaining electrodes 52 are arranged at the interface between the first and second main discharge spaces 131 and 132, respectively, and the third main discharge space 133 on the front plate 50. As in the above-described embodiment, the common electrodes 51 and sustaining electrodes 52 may further include auxiliary electrodes 51*a* and 52*a* extending toward one another from opposing sides thereof, respectively. The common electrodes 51 and sustaining electrodes 52 may be formed of conductive metal without limitation.

The aforementioned PDP 40' according to an embodiment of the present invention is driven as follows.

First, if a predetermined display data signal is applied to the data electrodes 42 and a scanning pulse voltage is applied to the sustaining electrodes 52, a preliminary discharge occurs within the main discharge space so that wall charges accumulate at ones of the main discharge spaces 101R, 101G, 101B. In this state, if a sustaining pulse voltage is applied to the sustaining electrodes 52, a sustaining discharge occurs by the wall charges on the protective film 54 on the sustaining electrodes 52. The sustaining discharge continues by alternately applying the sustaining pulse voltage to the common electrodes 51 and the sustaining electrodes 52. Ultraviolet (UV) radiation generated by the sustaining discharge excites the R, G and B phosphors coated on the first, second and third main discharge spaces 101R, 101G and 101B, respectively, and visible light generated from these phosphors is displayed on the front plate 50.

Another PDP driven based on the above-described operating principle with reference to FIG. 3 includes the partitions 100 formed of a meandering shape, and the first, second and third main discharge spaces 101R, 101G and 101B, respectively, are defined by the partitions 100. The width W1 of the first partition portion 103 forming the first and second main discharge spaces 101R and 101G, respectively, where the R and G phosphors are coated is greater than the width W2 of the second or third partition portion 104 or 105, respectively, forming the third main discharge space 101B where the B phosphor is coated. Thus, the area of the third main discharge space JOIB is widened, which compensates for a reduction in the luminous efficiency of the B phosphor, thereby improving a white balance characteristic. In particular, since the B phosphor is formed more thickly than the R and G phosphors, the luminous efficiency of the B phosphor can be further enhanced.

The common electrodes 51 and the sustaining electrodes 52 are arranged at the third partition portion 105 as a boundary between the first, second and third main discharge spaces 101R, 101G and 101B respectively. Thus, a decrease in the opening ratio of the main discharge spaces 101R, 101G and 101B, respectively, can be prevented by the electrodes 51 and 52. Since the common electrodes 51 and sustaining electrodes 52 have metal auxiliary electrodes 51*a* and 52*a* formed to project toward each other, a discharge starter voltage can be reduced by narrowing the gap between the common electrode 51 and the sustaining electrode 52. Also, a sustaining discharge occurring between the auxiliary electrodes 51*a* and 52*a* made of metal or ITO may spread over the area of the common electrodes 51 and sustaining electrodes 52 existing in the main discharge space, thereby extending a sustaining discharge area.

As shown in FIG. 5, the partition structure according to an embodiment of the present invention includes the first partitions 110 having the recessed portions 111 and the second partitions 120 disposed at either side of each of the first partitions 110 and having a meandering shape. The third main discharge space 133, where the B phosphor is coated, is formed only by the second partitions 120. That is, the third main discharge space 133 for B phosphor is easily obtained.

As described above, in the substrate having the partitions and the PDP utilizing the substrate according to the present invention, degradation in the white balance characteristic due to a difference in luminance among R, G and B phosphors can be prevented by increasing the B phosphor coated area. Also, the color temperature characteristic can be improved. Further, since common electrodes and sustaining electrodes are arranged at a boundary between first and second main discharge spaces and a third main discharge space, a decrease in the opening ratio of the main discharge spaces can be prevented.

While this invention has been particularly shown and described with reference to preferred embodiments thereof, it will be understood by those skilled in the art that various changes in form and details may be made therein without departing from the spirit and scope of the invention as defined by the claims and their equivalents.

What is claimed is:

1. A plate for use in a plasma display panel, comprising:

a substrate;

a dielectric layer formed on a top surface of the substrate; and partitions spaced a predetermined distance apart from each other and formed in a snaking shape in a common direction to form a plurality of channels between adjacent partitions, the channels including main discharge spaces and auxiliary discharge spaces alternately arranged and connected to each other through the channels;

wherein the partitions comprise first partition portions forming the main discharge spaces, second partition portions forming the auxiliary discharge spaces, and third partition portions connecting the first and second partition portions; and wherein widths of the first partition portions forming the main discharge spaces in which red and green phosphors are coated are greater than widths of the first partition portions forming the main discharge spaces in which a blue phosphor is coated.

2. The plate of claim 1, the blue phosphor being coated on the main discharge spaces at a thickness greater than a thickness of the red and green phosphors.

3. The plate of claim 1, wherein red, green and blue phosphors coated in the main discharge spaces are arranged in a triangular pattern with the red and green phosphors being aligned with each other in a first direction and the blue phosphors being located in a second direction relative to the red and green phosphors, the second direction being substantially perpendicular to the first direction.

4. A plate for a plasma display panel, comprising:

a substrate;

a dielectric layer formed on a top surface of the substrate;

first partitions formed in a striped pattern on a top surface of the dielectric layer and spaced a predetermined distance apart from each other, the first partitions including non-recessed portions and including recessed portions formed at opposite sides of the non-recessed portions; and second partitions spaced a predetermined distance apart from each other in a snaking shape to form main discharge spaces in cooperation with the recessed portions, and to form auxiliary discharge spaces in cooperation with lateral surfaces of the non-recessed portions.

5. The plate of claim 4, further comprising red and green phosphors coated on respective main discharge spaces formed by adjacent pairs of the first and second partitions, and a blue phosphor coated on main discharge spaces formed by adjacent pairs of the second partitions.

6. The plate of claim 5, a width of the blue phosphor being greater than a width of the red and green phosphors, respectively.

7. The plate of claim 4, further comprising first and second phosphors coated on respective first and second main discharge spaces formed by adjacent pairs of the first and second partitions, and a third phosphor coated on third main discharge spaces formed by adjacent pairs of the second partitions, each of the third main discharge spaces including an open area accommodating the third phosphor, the open area of each of the third main discharge spaces being greater than an open area of each of the first main discharge spaces accommodating the first phosphor, and greater than an open area of each of the second discharge spaces accommodating the second phosphor, the main discharge spaces including the first, second, and third main discharge spaces.

8. The plate of claim 7, further comprising sustaining and common electrodes arranged at a boundary between the first and second main discharge spaces and the third main discharge spaces.

9. The plate of claim 8, the sustaining and common electrodes each including auxiliary electrodes positioned in the main discharge spaces.

10. A plasma display panel, comprising:

a substrate;

data electrodes formed on a top surface of the substrate;

a first dielectric layer formed on the substrate to cover the data electrodes;

first partitions having a striped pattern, and spaced a predetermined distance apart from each other and disposed on a top surface of the first dielectric layer, the first partitions including recessed portions at opposite sides of non-recessed portions of the first partitions;

second partitions spaced a predetermined distance apart from each other in a snaking shape to form main discharge spaces in cooperation with the recessed portions, and to form auxiliary discharge spaces in cooperation with lateral surfaces of the non-recessed portions;

phosphors coated in the main discharge spaces;

a front plate sealed with the substrate;

common electrodes and sustaining electrodes arranged over the main discharge spaces in a direction not parallel with a direction of the data electrodes on a bottom surface of the front plate; and a second dielectric layer formed on the bottom surface of the front plate to cover the common and sustaining electrodes.

11. The plasma display panel of claim 10, the phosphors comprising red and green phosphors coated on the respective main discharge spaces formed by adjacent first and second partitions, and a blue phosphor coated on the respective main discharge spaces formed by adjacent second partitions.

12. The plasma display panel of claim 11 width of the blue phosphor being greater than a width of the red and green phosphors.

13. The plasma display panel of claim 11, further comprising auxiliary electrodes positioned in the main discharge spaces and extending toward one another from opposing sides of the common and sustaining electrodes.

14. The plasma display panel of claim 10, the common electrodes and the sustaining electrodes being arranged above a boundary between first and second main discharge spaces formed by adjacent first and second partitions and a third main discharge space formed by adjacent second partitions.

15. The plasma display panel of claim 10, the blue phosphor being coated on the main discharge spaces at a thickness greater than a thickness of the red and green phosphors.

16. A plate for use in a plasma display panel, comprising:

a substrate;

a dielectric layer formed on a top surface of the substrate; and partitions spaced a predetermined distance apart from each other and formed in a snaking shape in a common direction to form a plurality of channels between adjacent partitions, the channels including main discharge spaces and auxiliary discharge spaces alternately arranged and connected to each other through the channels;

wherein the partitions comprise first partition portions forming the main discharge spaces, second partition portions forming the auxiliary discharge spaces, and third partition portions connecting the first and second partition portions; and wherein a width of the first partition portions is greater than both a width of the second partition portions and a width of the third partition portions.

17. A plasma display panel comprising the plate of claim 16, and further comprising a common electrode and a sustaining electrode, each formed on the plate;

wherein said common electrode and said sustaining electrode are arranged on the third partition portions, whereby to increase an opening ratio of the main discharge spaces.

18. The plasma display panel of claim 17, further comprising auxiliary electrodes positioned on the main discharge spaces and extending from opposing sides of the common and sustaining electrodes, whereby to reduce a discharge starter voltage and extend a relative discharge area.

* * * * *